US011085239B2

(12) United States Patent
Slaughter, Jr.

(10) Patent No.: US 11,085,239 B2
(45) Date of Patent: Aug. 10, 2021

(54) SEALING SYSTEM FOR DOWNHOLE TOOL

(71) Applicant: The Charles Machine Works, Inc., Perry, OK (US)

(72) Inventor: Greg L. Slaughter, Jr., Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 93 days.

(21) Appl. No.: 16/295,587

(22) Filed: Mar. 7, 2019

(65) Prior Publication Data

US 2019/0277090 A1 Sep. 12, 2019

Related U.S. Application Data

(60) Provisional application No. 62/639,669, filed on Mar. 7, 2018.

(51) Int. Cl.
*E21B 4/00* (2006.01)

(52) U.S. Cl.
CPC ..... *E21B 4/003* (2013.01)

(58) Field of Classification Search
CPC ..... E21B 4/003
See application file for complete search history.

(56) References Cited

U.S. PATENT DOCUMENTS 2,944,795 A 7/1960 Le Bus, Sr.
4,019,591 A * 4/1977 Fox ..... E21B 4/003 175/107
4,361,194 A * 11/1982 Chow ..... E21B 4/003 175/107
5,195,754 A 3/1993 Dietle
5,490,569 A 2/1996 Brotherton et al.
5,803,187 A 9/1998 Javins
6,227,547 B1 5/2001 Dietle et al.
RE38,418 E 2/2004 Deken et al.
6,705,415 B1 3/2004 Falvey et al.
6,761,231 B1 7/2004 Dock et al.
6,827,158 B1 12/2004 Dimitroff et al.
7,216,724 B2 5/2007 Self et al.
7,798,496 B2 9/2010 Dietle et al.
9,316,319 B2 4/2016 Dietle
9,556,691 B2 1/2017 Van Zee et al.
(Continued)

OTHER PUBLICATIONS

Ditch Witch, "AT40 Rockmaster Housing", parts manual, undated, but were offered for sale in the United States more than 1 year prior to Mar. 7, 2018, 5 pages, Perry, Oklahoma.
(Continued)

*Primary Examiner* — D. Andrews
(74) *Attorney, Agent, or Firm* — Tomlinson McKinstry, P.C.

(57) ABSTRACT

A bearing assembly having independently rotatable concentric inner and outer tubes. A bearing chamber containing multiple bearings is disposed between the tubes, allowing thrust but not rotation to be transferred between them. The bearing chamber is sealed from the inside of the inner tube. To prevent high pressure fluid from leaking from the inner tube to an exterior of the tool through the bearing chamber, damaging components, a flow path is formed. An annular piston responds to high pressure within the bearing chamber and the inner tube, opening a flow path from the inner tube to the environment.

12 Claims, 12 Drawing Sheets

(56) References Cited

U.S. PATENT DOCUMENTS

| | | | |
|---|---|---|---|
| 9,611,695 | B2 | 4/2017 | Slaughter, Jr. et al. |
| RE46,746 | E | 3/2018 | Marchand et al. |
| 2013/0014992 | A1 | 1/2013 | Sharp et al. |
| 2013/0068490 | A1 | 3/2013 | Van Zee et al. |
| 2014/0027184 | A1 | 1/2014 | Slaughter, Jr. et al. |
| 2016/0084016 | A1 | 3/2016 | Slaughter, Jr. et al. |

OTHER PUBLICATIONS

United States Patent and Trademark Office, "Office Action Summary", dated May 26, 2016, 10 pages, Alexandria, VA.

* cited by examiner

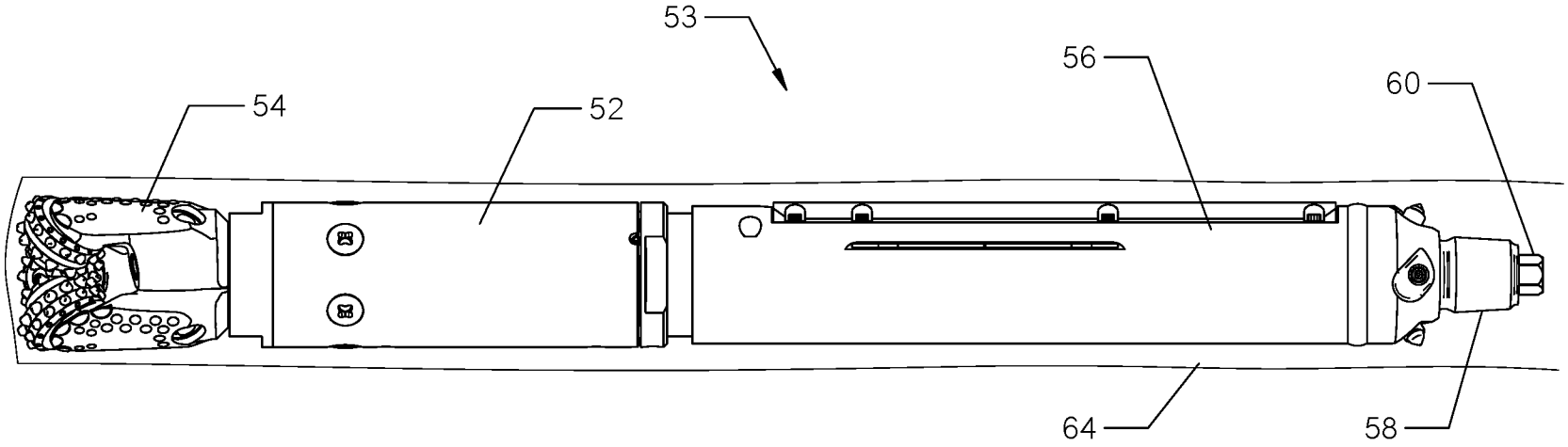
FIG. IA
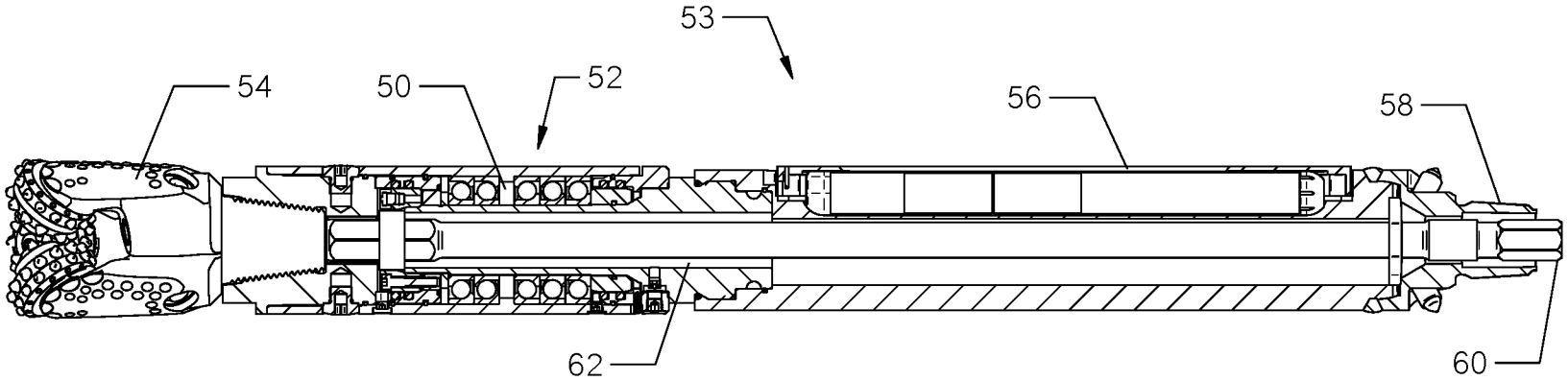
FIG. IB

SEALING SYSTEM FOR DOWNHOLE TOOL

SUMMARY

The present invention is directed to a downhole tool. The downhole tool comprises a cylindrical outer tube, a cylindrical inner tube, a bearing assembly, a first piston, and a second piston. The bearing assembly is disposed between the inner tube and outer tube and configured to allow relative rotation of the inner tube relative to the outer tube. The first piston is disposed at a first end of the bearing assembly between the inner tube and outer tube. The second piston is disposed at a second end of the bearing assembly between the inner tube and the outer tube. The downhole tool is characterized by three regions, each having its own fluid pressure. The first region is bounded by the inner tube, outer tube, first piston and second piston. The second region is disposed partially within the inner tube and in fluid contact with the first piston and the second piston. The third region is disposed outside of the outer tube.

In another embodiment the invention is directed to a system. The system comprises a pair of concentric and independently rotatable shafts situated within an environment. An annular zone is situated therebetween. A sealed chamber of variable volume is within the annular zone. The chamber is bounded in part at each end by an independently movable piston. The pistons comprise a first piston having an external side exposed to the annular zone and an internal side exposed to the chamber. The pistons also comprise a second piston having an external side exposed to the environment and an internal side exposed to the chamber. One or more bearings are contained within the chamber and interposed between the shafts. A flow path is located between the annular zone and the environment, bounded in part by the external side of the second piston.

BRIEF DESCRIPTION OF THE DRAWINGS

FIG. 1A is a side view of a downhole tool including a drill bit, a beacon housing, and a bearing assembly.

FIG. 1B is a sectional side view of the downhole tool of FIG. 1A.

DETAILED DESCRIPTION

The current state of the art for utility-HDD rock drilling involves using a sealed bearing system to permit rotation of an inner shaft inside of an outer shaft to drive a drill bit. This system is assembled under atmospheric conditions, and as a result, the bearing chamber maintains an absolute pressure that is roughly equivalent to the absolute atmospheric pressure at the time of assembly. However, once the bearing assembly is inserted into the borehole for use, the sealing system is at times responsible for isolating internal pressures inside of the drill string from those of the borehole, which may reach pressure differentials close to 1500 psi. This differential pressure results in significant forces on the sealing components, namely the seals themselves, often resulting in accelerated wear when compared to other systems which are isolated from the internal drill string pressures.

The present invention provides a solution to the above problem by equalizing the pressure between the bearing chamber and the internal passage without fluid communication. The invention further provides a path for high pressure fluid to leak from the internal passage of a downhole tool without entering the internal bearing chamber within the bearing assembly. Finally, the system provides a reliable method of lubricating downhole parts which rotate relative to one another and the environment.

Figure 11:
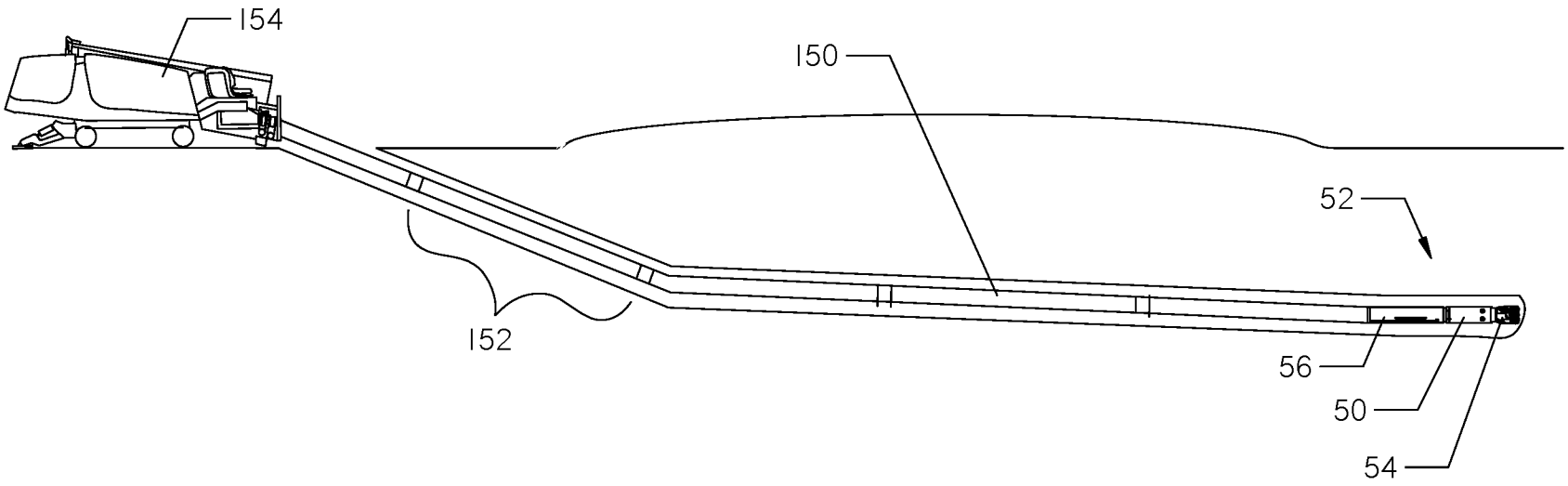
FIG. 11 is a diagrammatic representation of a horizontal directional drilling operation.

Turning now to the figures, FIGS. 1A, 1B and 11 show a bearing assembly 52 as a part of a downhole tool 53. The downhole tool 53 supports a drill bit 54 which rotates to open a borehole in an underground location. The downhole tool 53 is located at an end of a dual member drill string 150. The drill string 150 is made up of individual segments 152. Thrust and rotation is provided to the drill string 150 by a horizontal directional drill 154 disposed at an uphole location at an end of the drill string.

The downhole tool 53 comprises a beacon housing 56. The beacon housing 56 supports a beacon for conveying information about the position and orientation of the downhole tool 53 to an above ground location. This beacon housing 56 also comprises a connection 58 to an outer member of a dual member drill string 150 which provides thrust and rotational force to the downhole tool 53.

As best shown in FIG. 1B, the downhole tool 53 has an internally-disposed rotating shaft 60. The shaft 60 is coupled to an inner drill rod of the dual-member drill string 150. The shaft 60 is disposed in an internal passage 62 of the bearing assembly 52 of the downhole tool 53.

The present disclosure is directed to the sealed bearing chamber 50 within the bearing assembly 52 which is pressure compensated by the drilling fluid. Specifically, as shown in FIGS. 2-7B, an internal piston 10 and an external piston 12 work in concert to provide a path for leakage of drilling fluid which avoids the bearing chamber 50. The external piston 12 is exposed to the borehole which is being excavated by the drill bit 54. The internal piston 10 is not exposed to the borehole.

Figure 2:
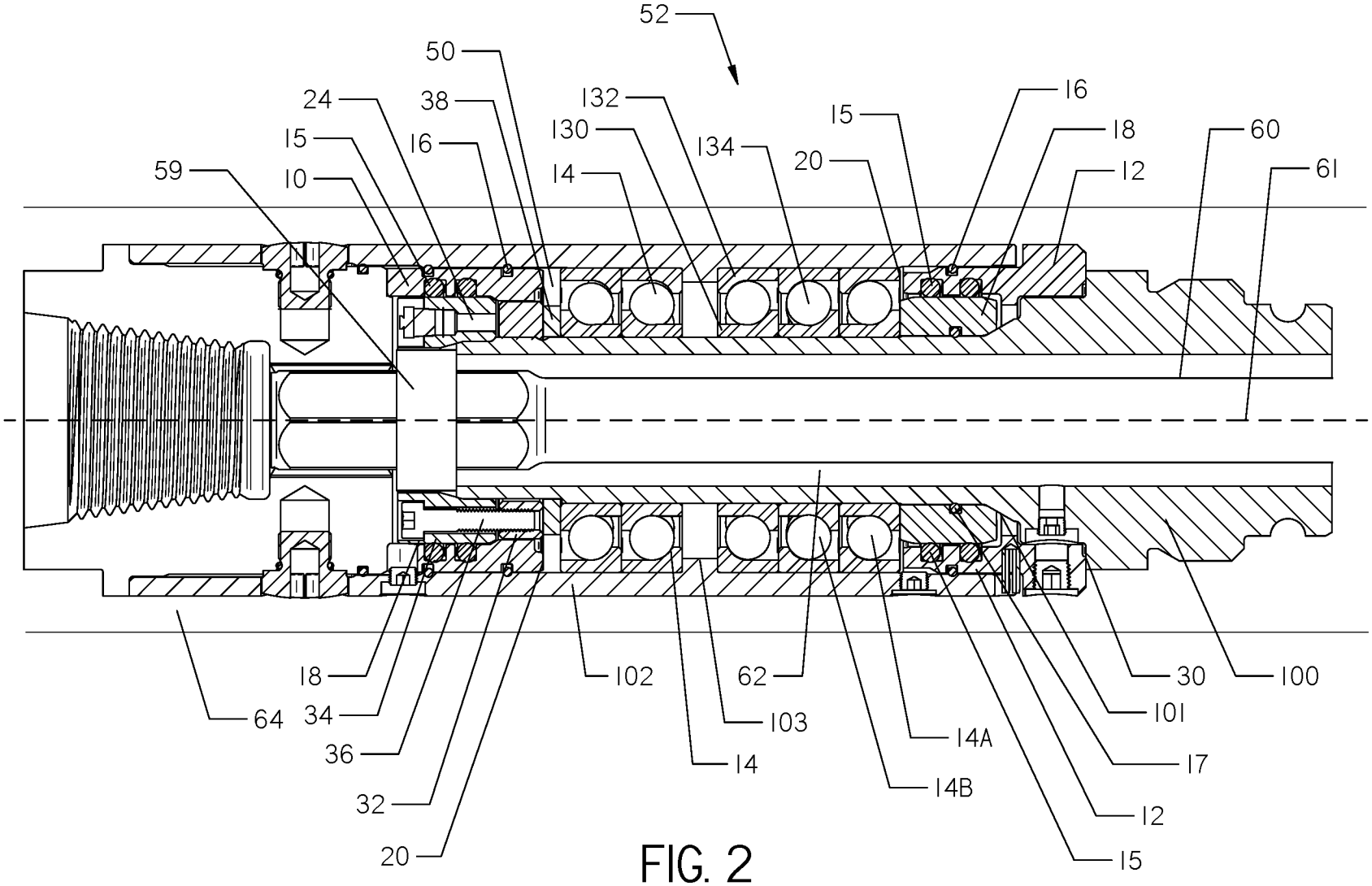
FIG. 2 is a cross-sectional side view of a bearing assembly for use with the downhole tool shown in FIG. 1B.

With reference now to FIG. 2, the bearing chamber 50 is shown in more detail. It should be understood that the bearing chamber 50 is disposed between an internal wall 100 and an outer wall 102 and houses multiple thrust bearings 14. Outer wall 102 is generally rotatable with the drill bit 54, and therefore the inner shaft 60 of the drill string. Inner wall or tube 100 is connected to and rotatable with the outer pipe of a dual member drill string (not shown).

The bearings 14 carry thrust between a shoulder 101 of the internal wall 100 and a shoulder or shoulders 103 of the outer wall. This allows thrust provided to the outer drill string (and thus the internal wall 100) to provide force at the drill bit 54 (FIGS. 1A-1B). At the same time, the bearings 14 allow relative rotation between the internal wall 100 and the outer wall 102.

Figure 10:
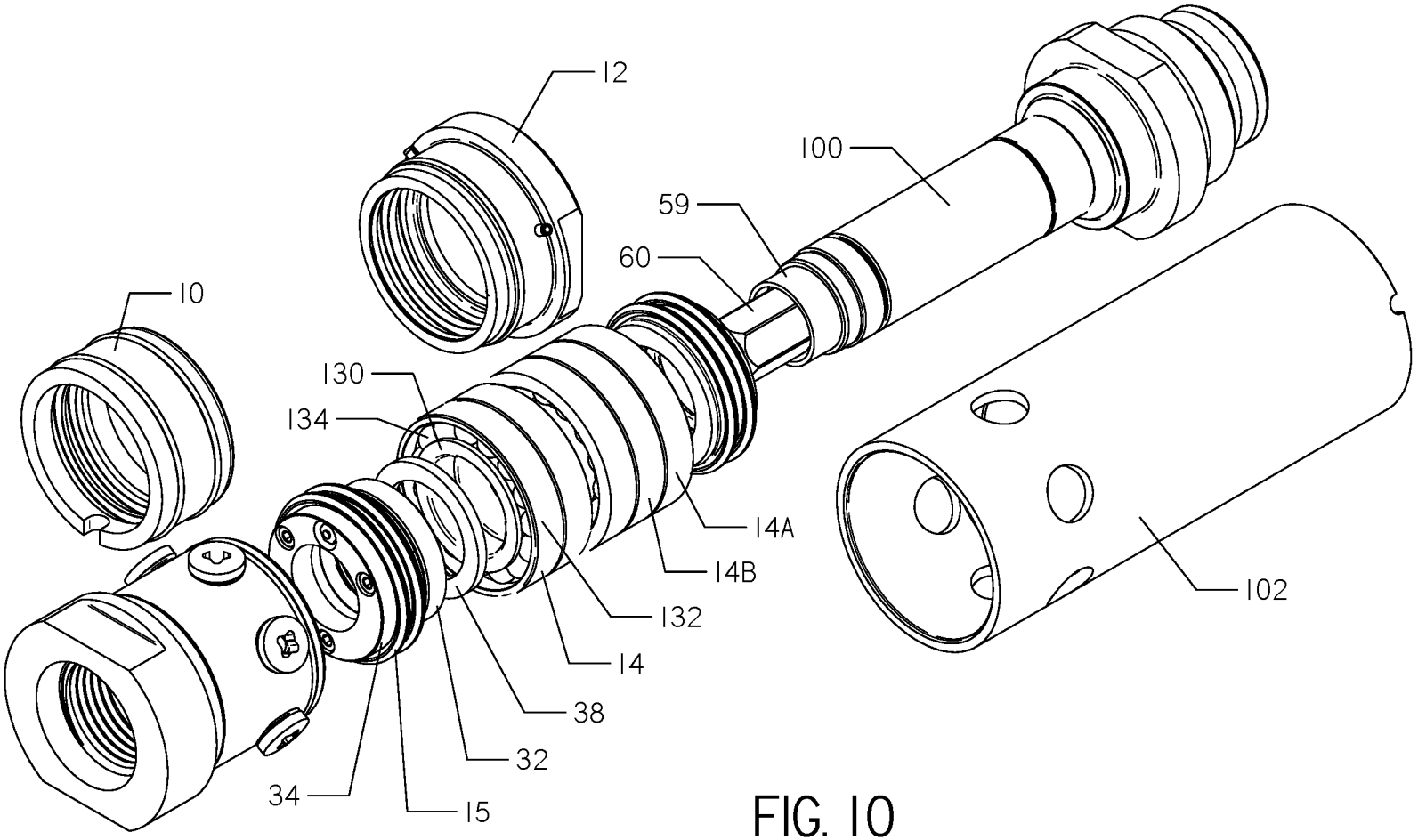
FIG. 10 is an exploded view of the bearing assembly of FIG. 2, with the outer wall, external piston and internal piston offset to show components that would otherwise be hidden from view.

As shown, the bearings 14 are in face-to-face and coaxial relationship. For example, as best shown in FIGS. 2 and 10, a first annular thrust bearing 14A transfers thrust from the shoulder 101 to a second annular thrust bearing 14B which is similarly formed and co-axial about a center axis 61 of the assembly.

Each bearing 14 has an inner ring 130 and an outer ring 132 that rotate relative to one another due to a plurality of ball bearings 134 interposed therebetween.

The pistons 10, 12 are disposed between the internal wall 100 and external wall 102 and allow pressure to equalize between the bearing chamber 50 and internal passage 62. The internal piston 10 and external piston 12 are capable of axial movement. This movement is parallel to the center axis 61.

Figure 8:
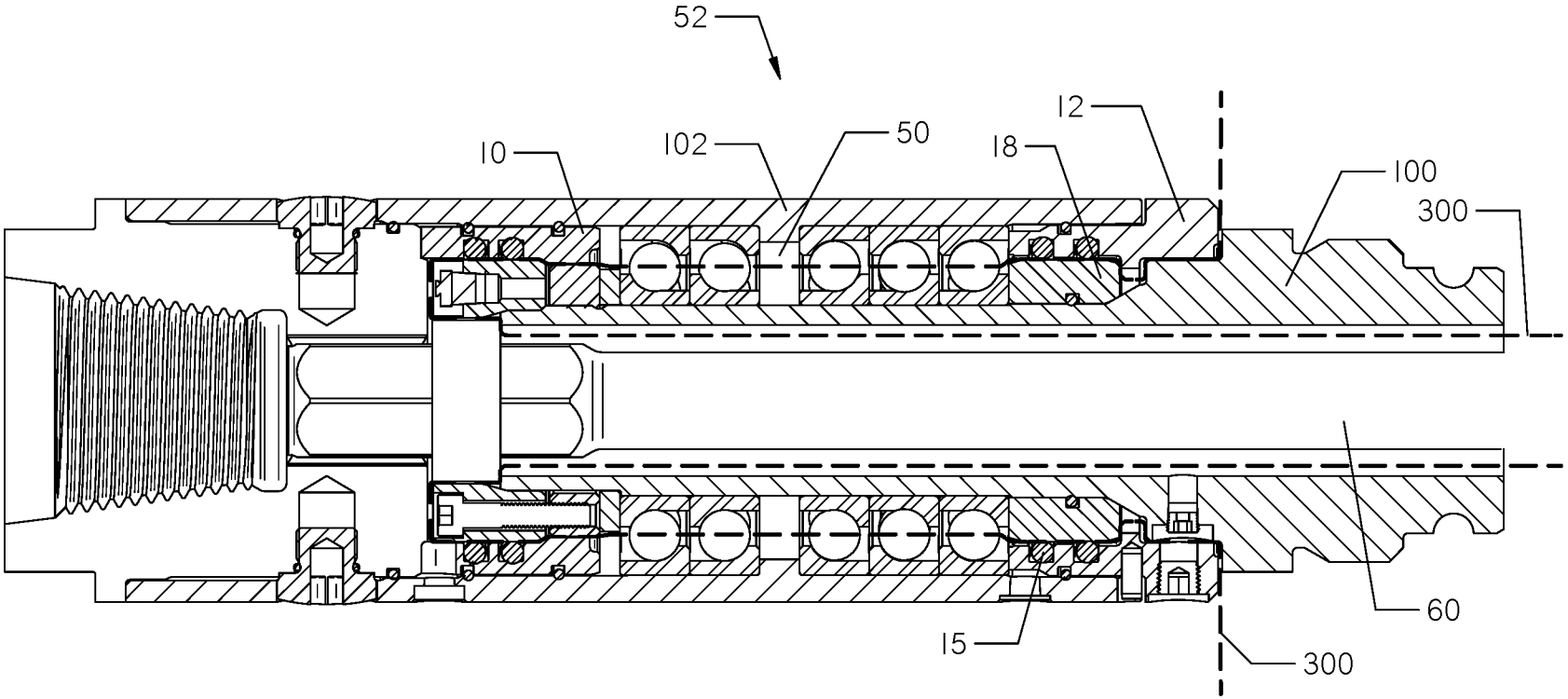
FIG. 8 is a cross-sectional side view as shown in FIG. 2, but with an imaginary boundary line drawn between two sections of the downhole tool to demonstrate which portions of the tool rotate together.

Rings 18 are disposed about the internal wall 100. The rings 18 carry thrust from the thrust bearings 14. The rings 18 seal against dynamic seals 15 disposed in pistons 10 and 12. Static seals 16 are disposed against pistons 10 and 12 within the external wall 102. Static seals 17 are disposed in the rings 18 and seal against the internal wall 100. The seals 15, 16, 17 prevent fluid from within the internal passage 62 from infiltrating the bearing chamber 50. The external seals 16, 17 may be elastomeric, as each surface contacting such seals does not rotate relative to the seal. Dynamic seals 15 may also be elastomeric, though other seal materials may be used. The dynamic seals 15 are seated in pistons 10, 12 but seal against rings 18. As shown in FIG. 8, these features rotate relative to one another.

Figure 7A:
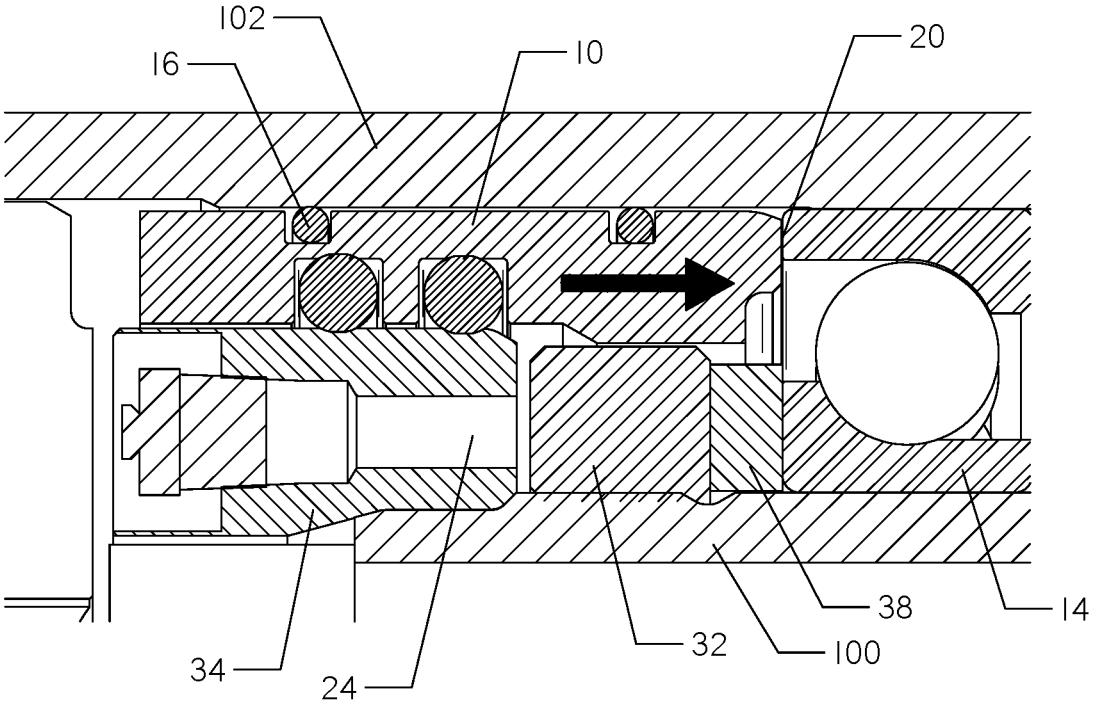
FIG. 7A is a sectional side view of the internal piston in its second position within the downhole tool.
Figure 7B:
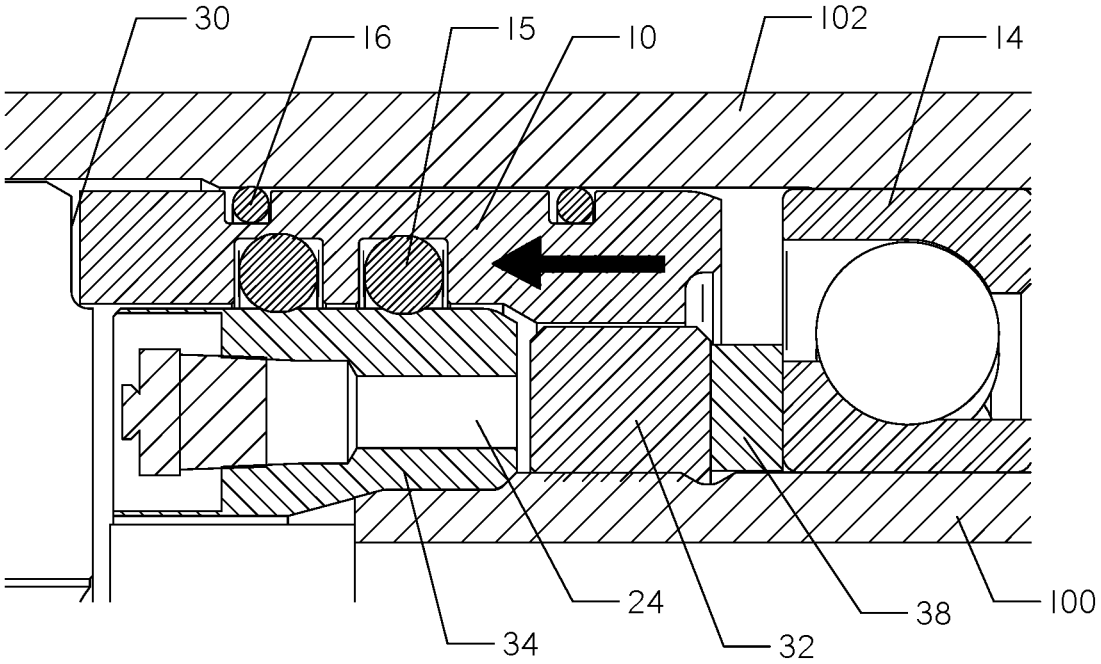
FIG. 7B is a sectional side view of the internal piston in its first position within the downhole tool.

As shown, the rings 18 may be formed in two parts, though solid rings may also be used. As best shown in FIGS. 7A-7B, ring 18 is formed of a first section 32 and a second section 34. The first section 32 is internally threaded and attached to externally-formed threads on the internal wall 100. The second section 34 provides a sealing surface for dynamic seals 15 within the internal piston 10. The sections 32, 34 may be connected by one or more bolts 36. A washer 38 is disposed between the first section 32 (or the ring 18 if unitary) and the bearings 14. The washer 38 applies substantially constant pressure to the thrust bearings 14 to keep them in place during operation.

Pressures in the bore annulus 64 are typically less than 30 psi absolute. Conversely, internal pressures found inside the internal passage 62 of the drill string will typically be from 50 psi to 1200 psi more than annular borehole pressures. In prior art bearing assemblies, the bearing chamber is subject to the pressure differential between the annular borehole pressure and the internal drill string pressure. Such pressure differential tends to cause fluid to escape from the internal drill string along a path which includes the bearing chamber, causing damage to the seals and infiltrating the chamber with abrasive drilling fluid.

For the purposes of this specification, it is instructive to define three pressure regions within and about the bearing assembly 52. The bearing chamber 50, including the area housing bearing 14 within the chamber between the sets of static seals 16, 17 and dynamic seals 15 is referred to herein as a first region. The internal passage 62 of the drill string and areas in direct fluid communication with the internal passage, is referred to herein as a second region. The region outside of the outer wall 102 and within the bore annulus 62 is referred to herein as a third region.

Each region has its own pressure profile which may change during operations. Because the internal piston 10 and external piston 12 are axially movable and each is bounded by the first and second regions, these regions tend to equalize pressure due to forces applied by the pistons and any other axially-movable components.

While drilling using the drill string and drill bit 54, internal pressures from the second region act upon the internal piston 10. The internal piston 10 and seals 15, 16, 17 thus tend to apply a pressure to fluid within the bearing chamber 50. High pressure within the bearing chamber 50 tends to lower its volume, moving the internal piston 10 towards the bearing chamber 50 as the force is applied.

FIG. 7A shows the internal piston when it has been moved towards the bearing chamber 50 due to high pressure. FIG. 7B shows the internal piston 10 at its furthest axial extent from the bearing chamber, such as when pressures in the first and second regions are low. It should be understood that distances travelled by the internal piston 10 are exaggerated for clarity.

Simultaneously, a port 90 formed in the inner wall between the internal passage 62 and a cavity 84 (FIGS. 4A, 4B, 5) allows pressure from the second region to act on the external piston 12. The absolute pressure in the cavity may be lower than the pressure of the second region due to the interposed port go. Such pressure results in application of a force on the external piston 12 which is opposite but parallel to the force on the internal piston 10.

The movement of pistons 10, 12 towards one another pressurizes the first region within the bearing chamber 50. While the pressure differential between the first and second region is non-zero, the relative equalization keeps wear on seals 16, 17 to a minimum. Because lubricating fluid within the bearing chamber 50 is highly incompressible, very little movement of the pistons 10, 12 results in a much higher pressure within the bearing chamber 50.

Ideal lubricants are grease or oil, but the lubricant could be any non-compressible fluid with or without lubricating properties. The use of compressible fluids would require pressurization of the bearing chamber 50 but could accomplish the same goal of downhole pressure equalization and wear mitigation.

While the term "incompressible" is used herein to describe lubricants within the bearing chamber 50, one of skill in the art will understand that some volumetric change of the space between the pistons 10, 12 will occur at high pressure. This is because lubricant within the chamber will necessarily include entrained air, air pockets, or the like, which will compress at high pressures. Thus, enough compression occurs within bearing chamber 50 to allow external piston 12 to move away from the shoulder 86.

Figure 4A:
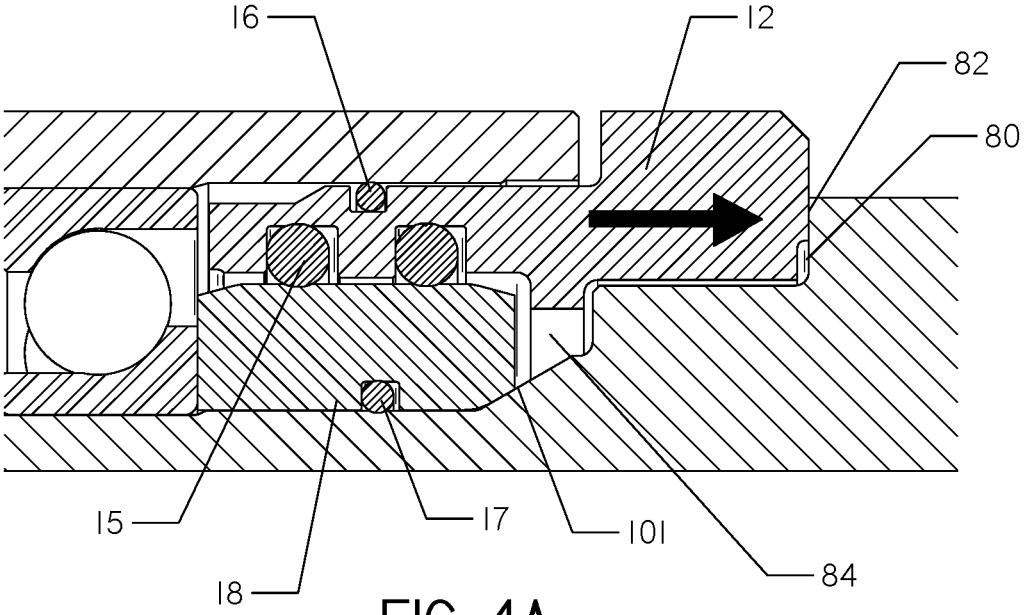
FIG. 4A is a sectional side view of an external piston in a first position, in contact with a shoulder of the bearing assembly.
Figure 4B:
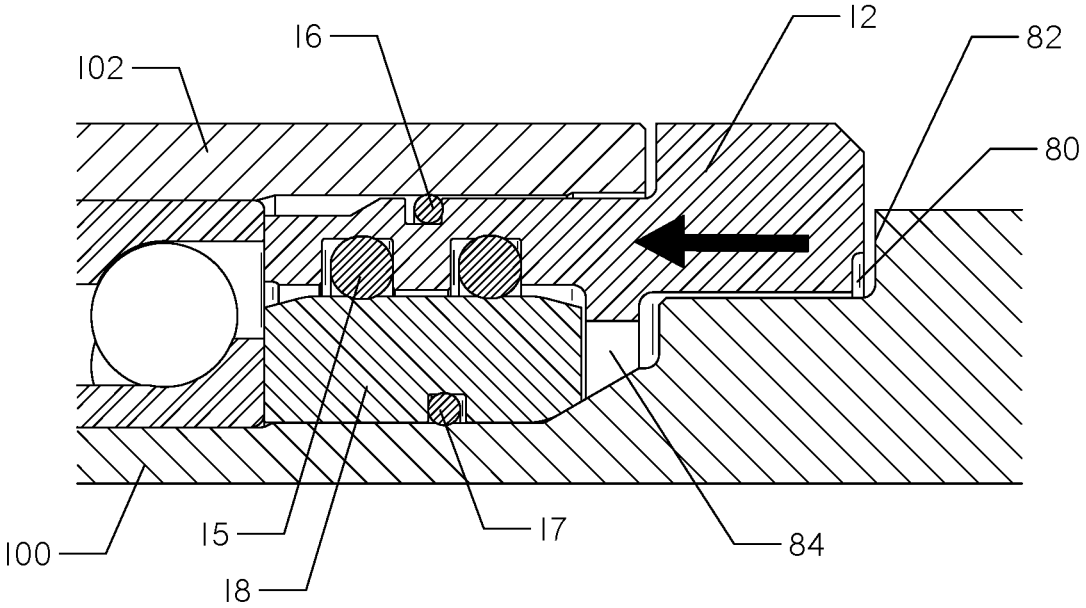
FIG. 4B is a sectional side view of the external piston in a second position, in which the piston is not in contact with the shoulder.
Figure 5:
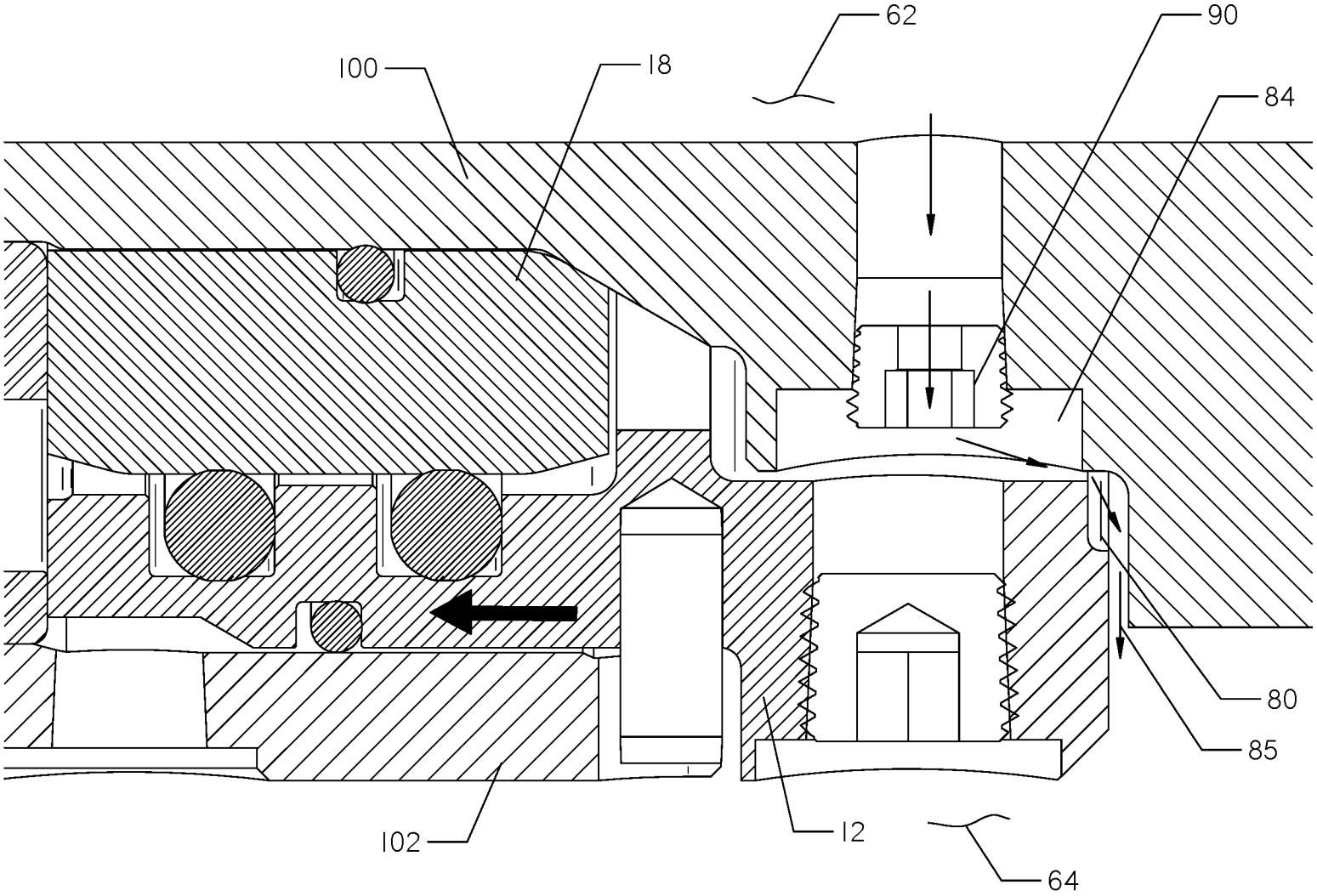
FIG. 5 is a sectional side view of the piston of FIG. 4B, in the second position, wherein a port is shown in the sectional view.

With reference to FIGS. 4A-4B and 5, the external piston 12 comprises a surface feature 80. The surface feature 80 limits the contact between the external piston 12 and the shoulder 86. As shown, the surface feature 80 is an annular notch. The contact point 82 between the external piston 12 and the shoulder 86 may be steel on steel, steel on polymer, ceramic on ceramic, ceramic on polymer, or steel on ceramic.

Figure 6A:
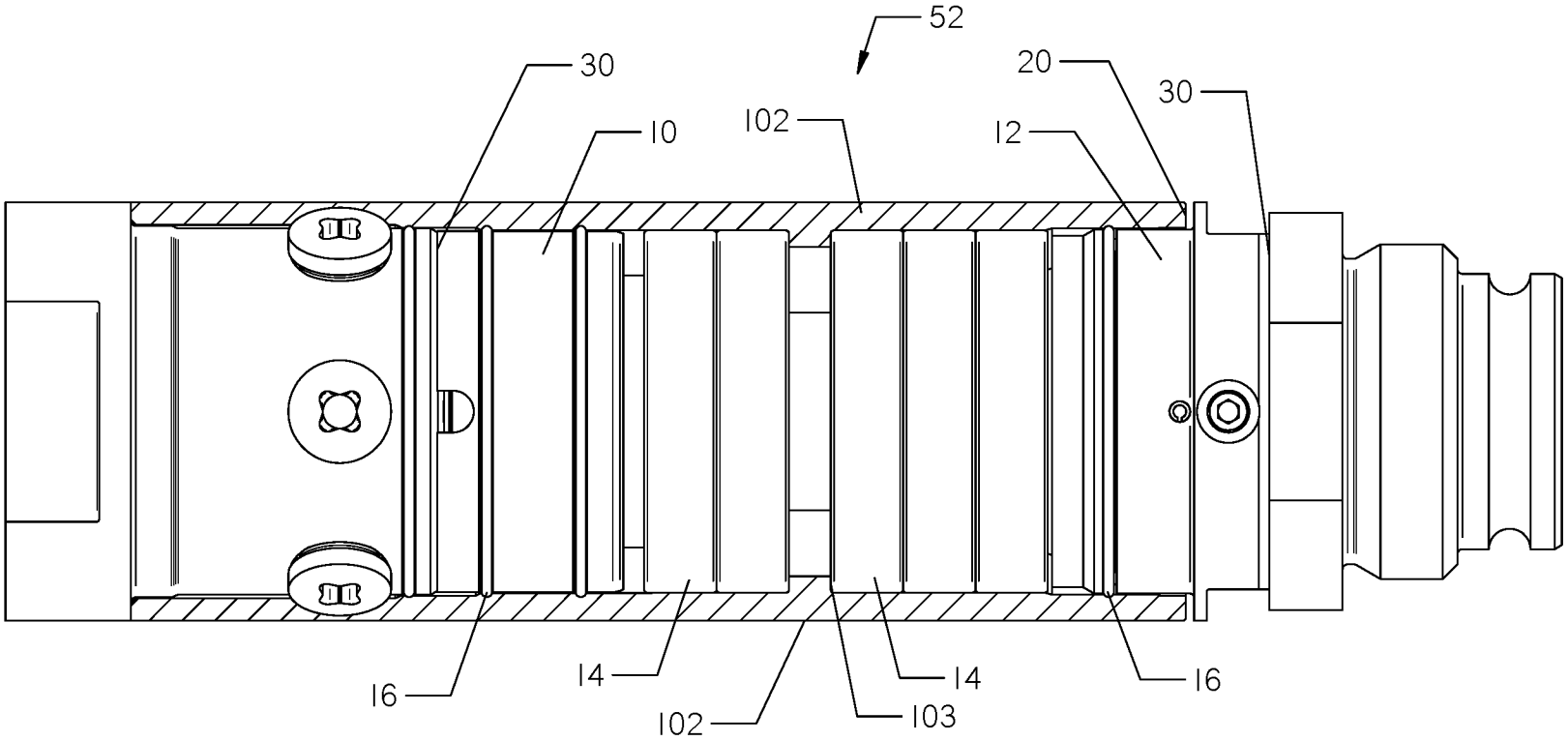
FIG. 6A is a cut-away side view of the external components of the bearing assembly, wherein the external piston is shown in a first position. An internal piston is shown in a first position.

The cavity 84 is isolated from the bearing chamber 50 by dynamic seals 15. When the pressure within the cavity 84 at surface feature 80 is low, pressure within the first region is also low. Because low pressure conditions are maximum volume conditions, the external piston abuts the contact point 82, sealing the cavity 84 from the third region. This orientation is shown in FIGS. 4A and 6A.

Figure 6B:
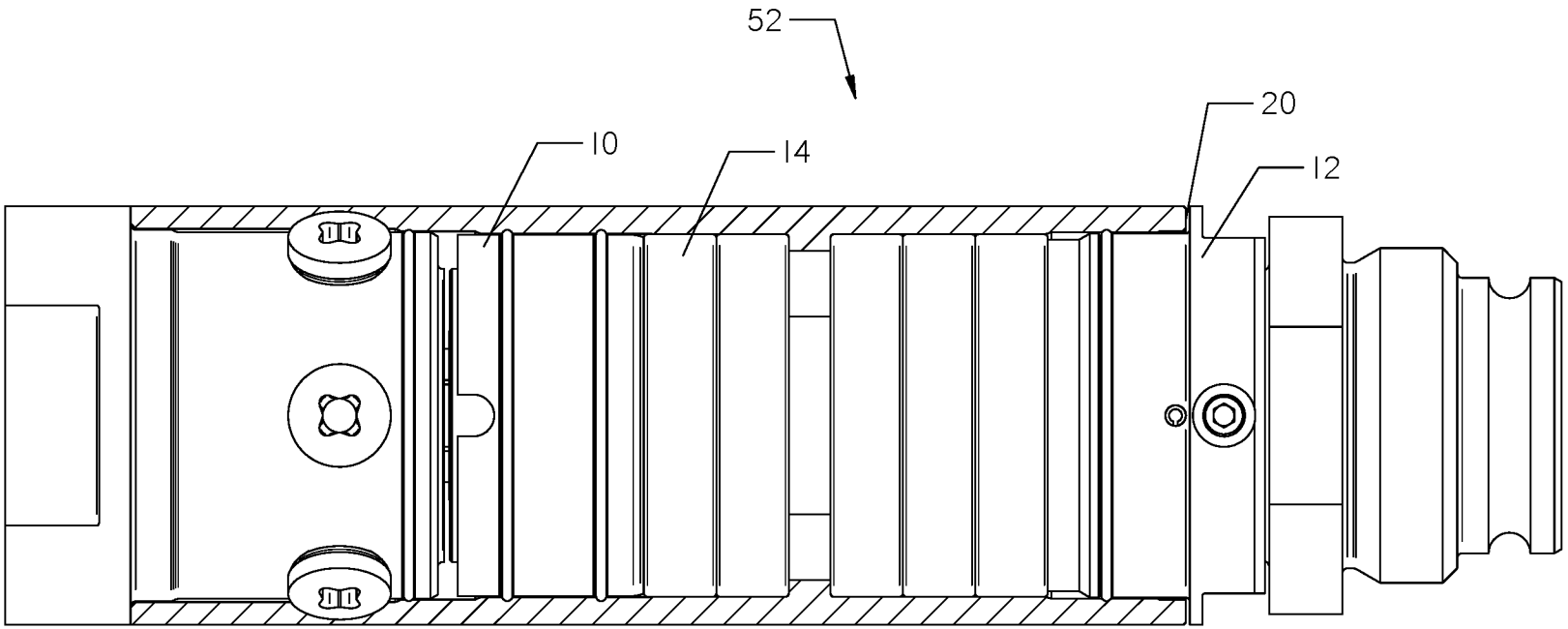
FIG. 6B is a cut-away side view as in FIG. 6A, but with the external piston in a second position. The internal piston is shown in a second position.

When pressure within the cavity 84 is increased due to high pressures within the second region, a differential pressure will be created between the first region and the second region and pressurization of the first region results. The pressure of the first region increases with the pressure of the second region, and the volume of the first region likewise tends to decrease. When the pressure within the first region exceeds a predetermined threshold, the force on the external piston 12 overcomes the static friction applied by seals 16, 15. As a result, the external piston 12 moves away, slightly, from the contact point 82 as shown in FIGS. 4B, 5 and 6B.

The external piston 12 therefore forms an intentionally unreliable seal, and opens a flow path 85 which allows movement of fluid from the cavity 84 to the third region outside of the outer wall 102 within the borehole annulus 64. The pressure differential between the third region and second region would otherwise tend to force fluid through the first region, across seals 15, 16, 17.

The flow of drilling fluid along flow path 85 further lubricates the outer surface of the bearing assembly 52 and outer wall 102, as well as the interface between shoulder 82 and external piston 12, where relative rotation occurs. Preferably, enough fluid flow occurs along flow path 85 during operation to maintain appropriate levels of lubrication.

The surface feature 80 on external piston 12 can be customized to particular pressure conditions. For example, the piston 12 may be sized so that it only partially reacts to the full force applied from the first region. This creates a less significant contact force at contact point 82 which is more easily overcome by pressure within the second region generally and the cavity 84 specifically. Alternatively, contact forces at contact point 82 may be externally increased or decreased by installation of a spring or other force carrying component (not shown).

The use of different wear materials at this location are also possible, each offering different sealing capacities or capabilities. The geometry of the contact point 82 may be formed to intentionally increase the length or restrictive properties of flow path 85. For example, the flow path could be zigzag or circuitous to lengthen the path 85, or radial grooves may be cut into surfaces to add flow.

In any case, the intent for the device is to allow intentional, controlled leakage along the flow path 85 so that pressure differential between the second and third regions do not adversely affect the first region. Specifically, high pressure differentials between the internal passage 62 and annulus 64 might tend to damage internal seals 15, 16. These are avoided by maintaining adequate fluid pressure within cavity 84 by allowing a restricted release of fluid from the cavity 84 into the bore annulus 64. If the flow rate is such that fluid flows out of cavity 84 into annulus 64 faster than fluid flows into cavity 84 from internal passage 62, significant pressure loss would occur within cavity 84. This pressure loss would cause an unwanted pressure differential between the bearing chamber 50 and cavity 84.

A diagrammatic representation of flow from passage 62, through port 90, and around external piston 12 is best shown in FIG. 5. It should be understood that the width of the flow passage 85 may be exaggerated for clarity.

While FIGS. 4A and 4B tend to show a large difference in the position of the external piston 12, it should be understood that very little movement is required to allow drilling fluid to travel along the flow path 85 in sufficient volume to lubricate the contact point 82 and outside of the outer wall 102, and to keep drilling fluid from entering the bearing chamber 50 and first region.

Figure 3:
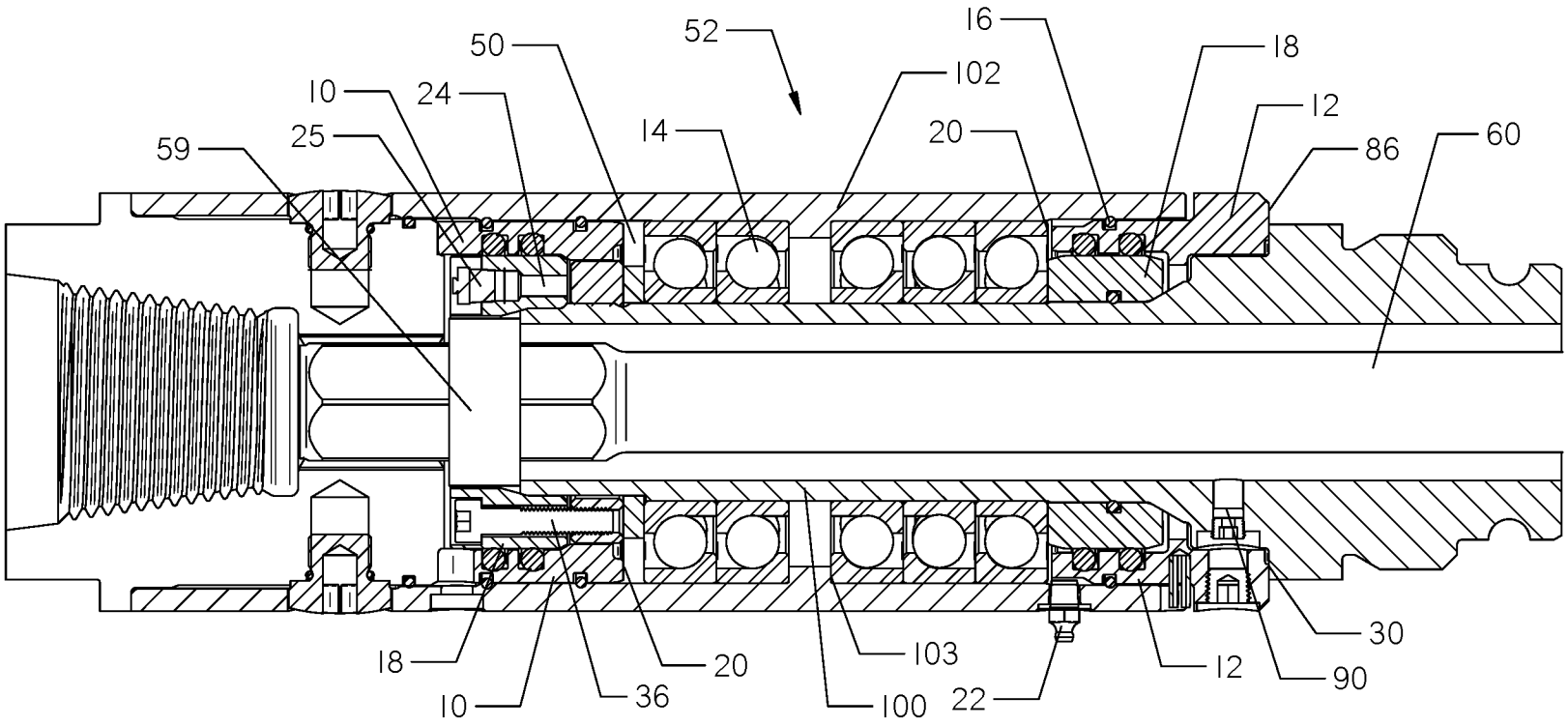
FIG. 3 is a cross-sectional side view of the bearing assembly with a zerk inserted into the bearing chamber.

FIG. 3 is representative of the bearing chamber 50 at the time of assembly, while being filled with lubricant. Internal piston 10 and external piston 12 are positioned such that the bearing chamber 50 volume is at its minimum (for example, see FIGS. 4B and 7A). The pistons 10, 12 are each contacting internal stops 20, which may be a surface of a thrust bearing 14. A lubricant filling apparatus, such as a zerk 22, is partially inserted into the bearing chamber 50, and lubricant is pumped or poured into the chamber at a first end. A port 24 is disposed at a second end of the bearing chamber 50. This port 24 is left open to allow air to escape during filling of the bearing chamber 50 with lubricant. As shown, the port 24 is disposed through ring 18, though other structures may be suitable for such a port. The port 24 may be a one-way flow pressure-relieving port.

Once the bearing chamber 50 is filled with lubricant, the port 24 is sealed with a plug 25 (FIG. 3). The addition of further lubricant through the zerk 22 pressurizes the bearing chamber 50. This pressurization should overcome the friction of the seals 15 and 16 such that the pistons 10, 12 traverse axially until the pistons 10, 12 contact external stops 30 as shown in FIGS. 3, 4A and 7B. As shown, the external stop 30 for the external piston 12 is the shoulder 86.

The zerk 22 is removed, and pressure inside of the bearing chamber 50 returns to atmospheric pressure. Simultaneously, the contact forces decrease and external stops 30 are reduced to coincidental contact, with no residual forces left from filling the bearing chamber 50. The zerk 22 is replaced with a plug, sealing the bearing chamber 50 and first region at the maximum volume/atmospheric pressure condition. The bearing chamber 50 is now ready for operation, as described above.

Because of the partially balanced relationship of the pressures described above, the leakage rate of lubricant is decreased. Moreover, as this lubricant is slowly leaked, the bearing chamber 50 can be flushed and recharged with lubricant by removing the plugs described above and flushing and refilling the bearing chamber 50 with desired lubricant in the same way as the cavity was filled during assembly. The resulting lower pressure differential reduces wear on seals 15, 16, improving the life of the bearing chamber 50 and its components.

Throughout, the bearing assembly 52 is shown in cross-section to aid in understanding of the orientation of its parts across its volume. However, it should be understood that many of the seals, pistons, bearings, and other features described herein are annular in nature. FIGS. 6A and 6B show the bearing assembly 52 with the outer wall 102 cut away so that pistons 10, 12, bearings 14, and static seals 16 may be clearly seen in their annular forms. Further, FIG. 10 shows the apparatus in exploded view for the same purpose, with pistons 10, 12 offset from the bearing assembly so that inner rings 18 and seals may be viewed.

With reference to FIG. 8, a boundary line 300 is shown to illustrate relative rotation of the components of the bearing assembly 52. Features on a first side of the boundary line 300 rotate together, while features on a second side of the boundary line 300 also rotate together. For example, the internal shaft 60, outer wall 102, and pistons 10, 12 are on a first side of the boundary line 300. Internal wall 100, rings 18 are on the second side of the boundary line 300. Thrust bearings 14 are split, such that the outer ring 132 is on the first side and inner ring 130 is on the second side.

Figure 9:
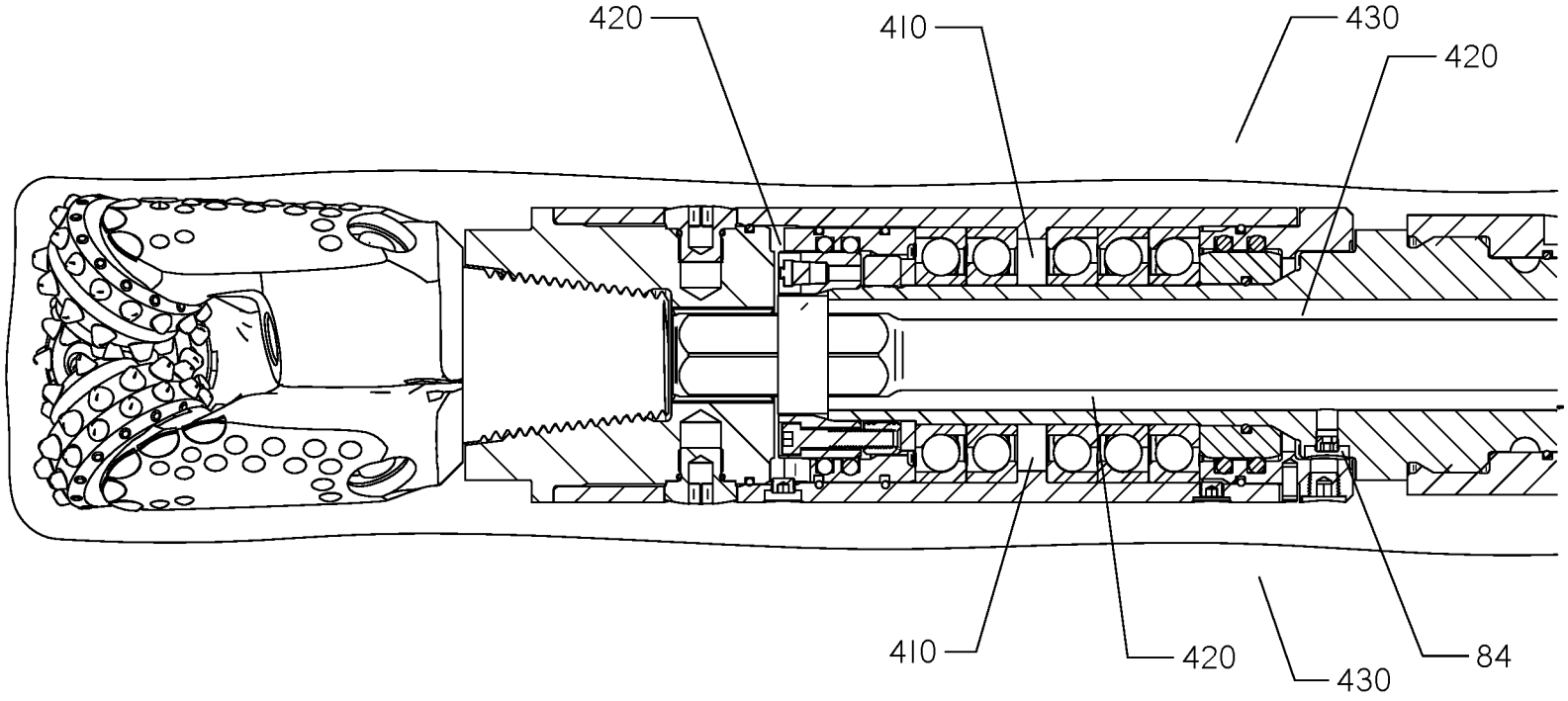
FIG. 9 is a cross-sectional side view of the bearing assembly within a borehole annulus, with a first, second and third region, each having its own fluid pressure called out and marked.

In FIG. 9, the first region 410, second region 420 and third region 430 are shown. The cavity 84 is in fluid communication with the second region 420, but may have a lower pressure due to flow through the port 90, and because of its position along the flow path 85 (FIG. 5).

Changes may be made in the construction, operation and arrangement of the various parts, elements, steps and procedures described herein without departing from the spirit and scope of the invention as described in the following claims.

The invention claimed is:

1. A downhole tool comprising:
- a cylindrical outer tube;
- a cylindrical, elongate inner tube;
- a bearing assembly disposed between the inner tube and outer tube and configured to allow relative rotation of the inner tube relative to the outer tube;
- a first piston disposed at a first end of the bearing assembly between the inner tube and outer tube, the first piston defining an annular notch; and
- a second piston disposed at a second end of the bearing assembly between the inner tube and the outer tube;
- wherein the downhole tool is characterized by:
  - a first region having a first fluid pressure, wherein the first region is bounded by the inner tube, outer tube, first piston and second piston;
  - a second region having a second fluid pressure, wherein the second region is disposed at least partially within the inner tube and in fluid contact with the first piston and second piston, the second region including a cavity bounded in part by the first piston and the inner tube; and
  - a third region having a third fluid pressure, disposed outside of the outer tube;
- in which the first piston is axially movable in response to the second fluid pressure; and
- in which the annular notch is exposed to the cavity.

2. The downhole tool of claim 1 in which the second piston is axially movable in response to the second fluid pressure.

3. The downhole tool of claim 1 in which the first region is filled with a lubricant.

4. The downhole tool of claim 1 in which a ring surrounds the inner tube adjacent the second piston, the ring having an inner port formed therein that joins the first and second regions.

5. The downhole tool of claim 4 in which the outer tube comprises an outer port that joins the first and third regions.

6. The downhole tool of claim 1 further comprising:
- a rotating inner rod disposed within the inner elongate tube;
- a drill bit attached to the outer tube and rotated by the inner rod;
- wherein the inner tube is characterized by a shoulder in contact with the bearing assembly, such that the shoulder conveys a thrust force through the bearing assembly to the drill bit.

7. The downhole tool of claim 1 in which the bearing assembly comprises a first annular thrust bearing and a second annular thrust bearing arranged in coaxial engagement.

8. A method of using a downhole tool comprising:
- a cylindrical outer tube;
- a cylindrical, elongate inner tube;
- a bearing assembly disposed between the inner tube and outer tube and configured to allow relative rotation of the inner tube relative to the outer tube;
- a first piston disposed at a first end of the bearing assembly between the inner tube and outer tube; and
- a second piston disposed at a second end of the bearing assembly between the inner tube and the outer tube;
- wherein the downhole tool is characterized by:
  - a first region having a first fluid pressure, wherein the first region is bounded by the inner tube, outer tube, first piston and second piston;
  - a second region having a second fluid pressure, wherein the second region is disposed at least partially within the inner tube and in fluid contact with the first piston and second piston; and
  - a third region having a third fluid pressure, disposed outside of the outer tube;
- in which the first piston is axially movable in response to the second fluid pressure;
- the method comprising the steps of:
  - expanding the volume of the first region; and
  - increasing fluid pressure in the second region until axial movement of the first piston opens a fluid path between the second and third regions.

9. A system, comprising:
- a pair of concentric and independently rotatable shafts situated within an environment, the shafts having an annular zone therebetween;
- a sealed chamber of variable volume within the annular zone, the chamber bounded in part at each end by an independently movable piston, the pistons comprising:
  - a first piston having an external side exposed to the annular zone and an internal side exposed to the chamber; and
  - a second piston having an external side exposed to the environment and an internal side exposed to the chamber;
- one or more bearings contained within the chamber and interposed between the shafts; and
- a flow path between the annular zone and the environment, the flow path bounded in part by the external side of the second piston;
- in which the flow path opens and closes in response to the movement of the second piston.

10. The system of claim 9 in which the environment is an underground borehole and in which pressurized drilling fluid is propelled through the annular zone.

11. The system of claim 9 further comprising a ring situated between the shafts, in which the ring has an external side exposed to the annular zone and an internal side exposed to the chamber, and at least one port interposed within the ring connecting the annular zone and the chamber.

12. The system of claim 11 in which the ring comprises:
- a first portion comprising the internal side of the ring, wherein the first portion is threaded to one of the independently rotatable shafts;
- a second portion comprising the external side of the ring; and a connector joining the first portion and the second portion.

* * * * *